United States Patent [19]

Schinner

[11] 4,196,157

[45] Apr. 1, 1980

[54] EVAPORATIVE COUNTERFLOW HEAT EXCHANGE

[75] Inventor: Edward N. Schinner, Silver Spring, Md.

[73] Assignee: Baltimore Aircoil Company, Inc., Jessup, Md.

[21] Appl. No.: 922,454

[22] Filed: Jul. 6, 1978

[51] Int. Cl.[2] ..... B01F 3/04

[52] U.S. Cl. ..... 261/155; 62/305; 62/310; 165/DIG. 1; 261/29; 261/30; 261/DIG. 11

[58] Field of Search ..... 261/30, 36 R, 109-112, 261/152-154, 29, DIG. 11, DIG. 77; 55/257 R, 259; 165/DIG. 1; 62/2, 156, 282, 305, 310; 122/510

[56] References Cited

U.S. PATENT DOCUMENTS

| | | | |
|---|---|---|---|
| 712,704 | 11/1902 | Morris | 261/DIG. 11 |
| 2,076,119 | 4/1937 | Carraway | 261/111 |
| 2,228,484 | 1/1941 | Ramsaur et al. | 62/156 |
| 2,384,861 | 9/1945 | Roswell | 261/153 |
| 2,454,883 | 11/1948 | Olstad et al. | 62/2 |
| 2,680,599 | 6/1954 | Wile | 261/DIG. 11 |
| 2,752,124 | 6/1956 | Nofziger | 261/DIG. 11 |
| 2,840,352 | 6/1958 | Ghai et al. | 261/DIG. 11 |
| 2,890,864 | 6/1959 | Stutz | 261/DIG. 11 |
| 2,919,559 | 1/1960 | Koch | 62/305 |
| 2,923,138 | 2/1960 | Rollins | 62/282 |
| 2,933,904 | 4/1960 | Wellman | 62/305 |
| 3,132,190 | 5/1964 | Engalitcheff, Jr. | 261/30 |
| 3,148,516 | 9/1964 | Kals | 62/305 |
| 3,259,112 | 7/1966 | Lee | 122/510 |
| 3,265,372 | 8/1966 | Bradley | 261/30 |
| 3,442,494 | 5/1969 | Engalitcheff, Jr. et al. | 261/29 |
| 3,504,738 | 4/1970 | McGuffey | 261/153 X |
| 3,800,553 | 4/1974 | Engalitcheff, Jr. | 62/310 |
| 3,969,450 | 7/1976 | Hengstebeck | 261/153 |
| 3,996,314 | 12/1976 | Lakmaker | 261/30 |

OTHER PUBLICATIONS

Imeco, Inc., "Evaporative Condensers", Bulletin S-160.1, Feb., 1972.

*Primary Examiner*—Richard L. Chiesa
*Attorney, Agent, or Firm*—Michael C. Sudol, Jr.

[57] ABSTRACT

A counterflow evaporative heat exchanger comprises a vertical conduit in which a coil assembly is positioned. A fluid to be cooled or condensed passes through the coil assembly while water is sprayed downwardly over it and air is blown upwardly through it. The coil assembly comprises a plurality of tubes which at each level in the assembly are spaced apart from each other in the horizontal direction by an amount greater than the diameter of the tubes. This has been found to improve heat transfer in comparison to counterflow evaporative heat exchangers using closely packed coil assemblies.

9 Claims, 9 Drawing Figures

EVAPORATIVE COUNTERFLOW HEAT EXCHANGE

BACKGROUND OF THE INVENTION

1. Field of the Invention

This invention relates to evaporative heat exchange of the type in which a fluid to be cooled or condensed passes through an array of tubes while a liquid and a gas pass in counterflow relationship over the outer surfaces of the tubes.

2. Description of the Prior Art

Counterflow evaporative heat exchangers are shown and described in U.S. Pat. Nos. 3,132,190 and 3,265,372. Those heat exchangers comprise an upwardly extending conduit containing an array of tubes which form a coil assembly. A spray section is provided in the conduit above the coil assembly to spray water down over the tubes; and a fan is arranged to blow air into the conduit near the bottom thereof and up between the tubes in counterflow relationship to the downwardly flowing sprayed water. Heat from the fluid passing through the coil assembly tubes is transferred through the tube walls to the water sprayed down over the tubes; and the upwardly flowing air causes partial evaporation of some of the water and transfer of heat from the water to the air. The thus heated air then flows upwardly and out from the system. The remaining water collects at the bottom of the conduit and is pumped back up and out through spray nozzles in recirculatory fashion.

The following additional United States patents also disclose countercurrent or crosscurrent liquid-gas evaporator type heat exchangers as thus broadly described: U.S. Pat. Nos. 712,704, 2,076,119, 2,228,484, 2,454,883, 2,680,599, 2,840,352, 2,933,904 and 3,996,314.

None of the foregoing patents is concerned with the particular arrangement of tubing which makes up the coil assembly; and the effect of the arrangement or positioning of the tubes on heat transfer is not discussed in those patents. In most cases the tube arrangements are shown only schematically or incompletely. In general, however, the coil assembly tubes were packed into as tight an array as possible to maximize the tube surface area available for heat transfer. A tightly packed coil assembly also maximizes the velocity of the air flowing between adjacent tube segments. The resulting high relative velocity between the air and water promotes evaporation and thereby enhances heat transfer. In several of the above identified patents the surface area of the coil assembly tubes is further increased by the use of closely spaced fins which extend outwardly, in a horizontal direction, from the surface of the tube segments.

There are other evaporative type heat exchangers in which the liquid and gas flow in the same direction over the coil assembly. Examples of these other devices, which are generally referred to as co-current flow heat exchangers, are shown in U.S. Pat. Nos. 2,752,124, 2,890,864, 2,919,559, 3,148,516 and 3,800,553. In the systems of the first four patents, the cooling coil tubes are shown spaced apart but no indication is given that the coil spacing has any effect on heat transfer. In any event it has been recognized in the prior art that heat transfer in an evaporative heat transfer device, whether of the co-current flow type or the countercurrent flow type, is directly related to the total surface area of the heat exchange tubes carried in the apparatus. Accordingly, it has been the teaching of the prior art that where heat transfer was to be maximized, the heat exchange tubes should be packed together as tightly as possible.

In the system of the last mentioned patent the cooling tubes are shown closely packed.

SUMMARY OF THE INVENTION

The present invention has for an object to increase the net amount of heat transfer per unit area of cooling tube surface in a counterflow evaporative heat exchanger.

The invention has for another object the lowering of construction costs of a counterflow evaporative heat transfer device without any corresponding reduction in heat transfer capability and without any increase in operating costs.

It is a still further object of the invention to improve the cleanability of cooling coil tubes in a counterflow evaporative heat exchanger.

The present invention achieves these objects in a novel manner. According to one aspect of the present invention, the number of tubes in the coil assembly of a counterflow heat exchanger is reduced from that which would previously have been considered necessary to provide maximum heat transfer area and maximum gas flow velocity. More specifically, according to this aspect of the invention, the coil assembly in a counterflow type evaporative heat exchanger is arranged in a conduit up through which a gas, such as air, is blown and down through which a liquid, such as water, is sprayed or otherwise distributed. The coil assembly is made up of arrays of substantially equally spaced apart tube segments located at different levels in the coil assembly region of the conduit. The tube segments are spaced apart horizontally at each level by an amount such that the space between adjacent tubes is greater than the diameter of the tube segments but not substantially greater than twice their diameter. Thus at each level in the conduit the portion of the coil assembly occupied by tube segments is less than fifty percent but not substantially less than twenty five percent.

The above described spacing of tube segments results in a significant reduction in the amount of tubing used in comparison to prior art tightly packed coil assemblies; and accordingly the cost of the coil assembly of the present invention is correspondingly reduced from such prior art coil assemblies. Although this reduction in coil assembly tubing is accompanied by a corresponding reduction in tube heat transfer surface area, it has been found, surprisingly, that the heat transfer for each unit area of the cooling tubes is actually increased; and where the number of tube segments is such as to occupy approximately forty percent of the coil assembly cross section at each level in the heat exchanger, the overall heat transfer capacity of the heat exchanger is also increased.

According to a further aspect of the present invention, counterflow evaporative heat transfer is carried out by spraying water down over an assembly of tubes and blowing air up between the tubes while a fluid to be condensed or cooled flows through the tubes. The water is sprayed at a rate sufficient to form water films on the tube. The air, in turn, is blown upwardly at a velocity in the vicinity of the tubes sufficient to shear water from the films but insufficient to strip the films completely from the tubes. More specifically, the air velocity in the vicinity of the tubes is maintained at more than four hundred feet (122 meters) per minute but less than fourteen hundred feet (427 meters) per minute. Preferably the air velocity is maintained at about one thousand feet (305 meters) per minute in the vicinity of the tubes. Water sheared from the films is entrained in the upwardly flowing air but after the air leaves the tubes it passes through mist eliminators which recover the water and redirects it back over the tubes.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

Selected embodiments of the invention have been chosen for purposes of illustration and description, and are shown in the accompanying drawings, forming a part of the specification, wherein.

DETAILED DESCRIPTION OF THE PREFERRED EMBODIMENTS

Figure 1:
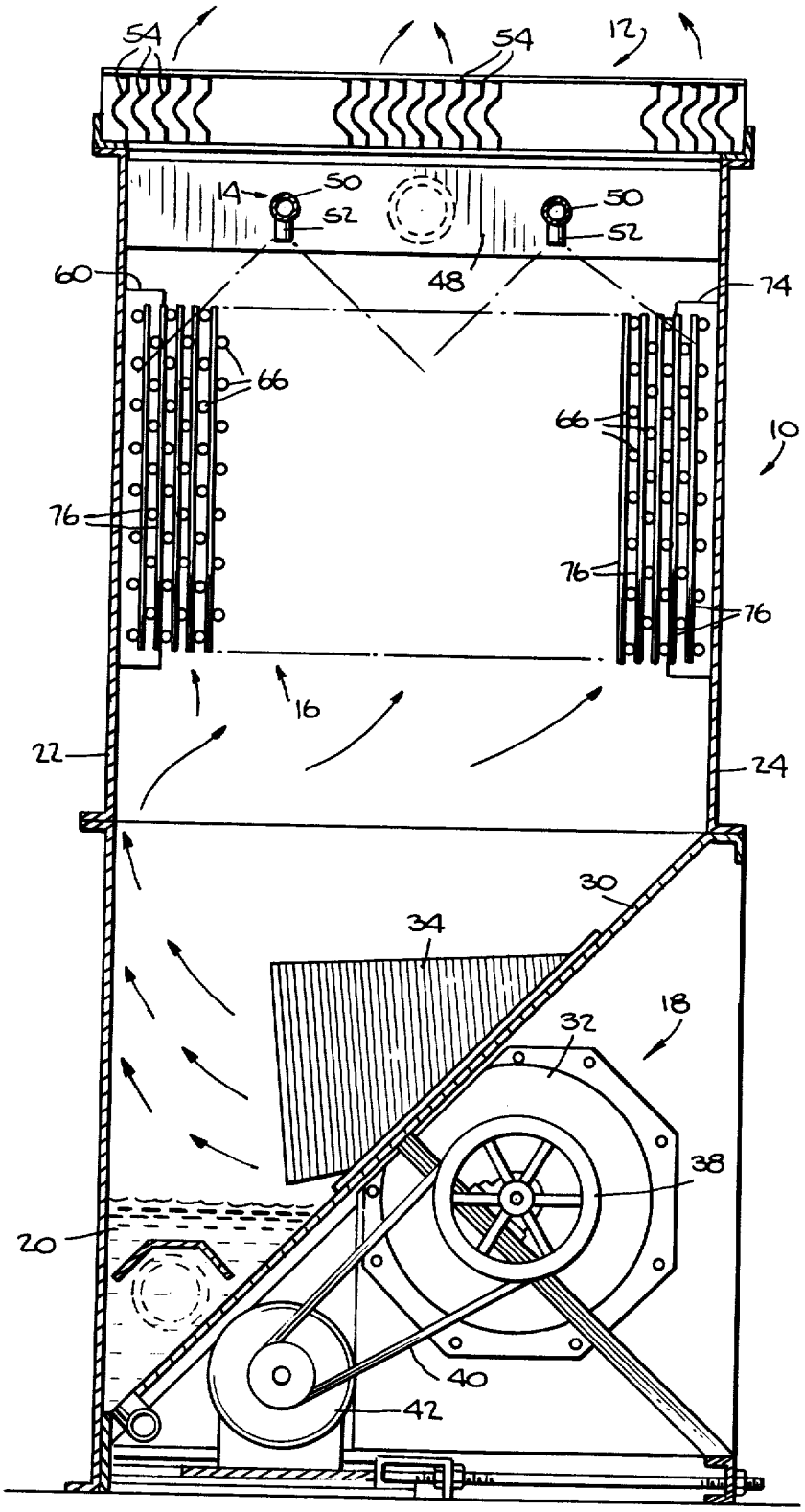
FIG. 1 is a side elevational view, partially in section of a counterflow evaporative type liquid-gas heat exchanger according to the present invention.

The heat exchanger shown in FIGS. 1-6 comprises a generally vertical conduit 10 of sheet metal construction and having, at different levels in the interior thereof, an upper mist eliminator assembly 12, a water spray assembly 14, a coil assembly 16, a fan assembly 18 and a lower water trough 20.

Figure 2:
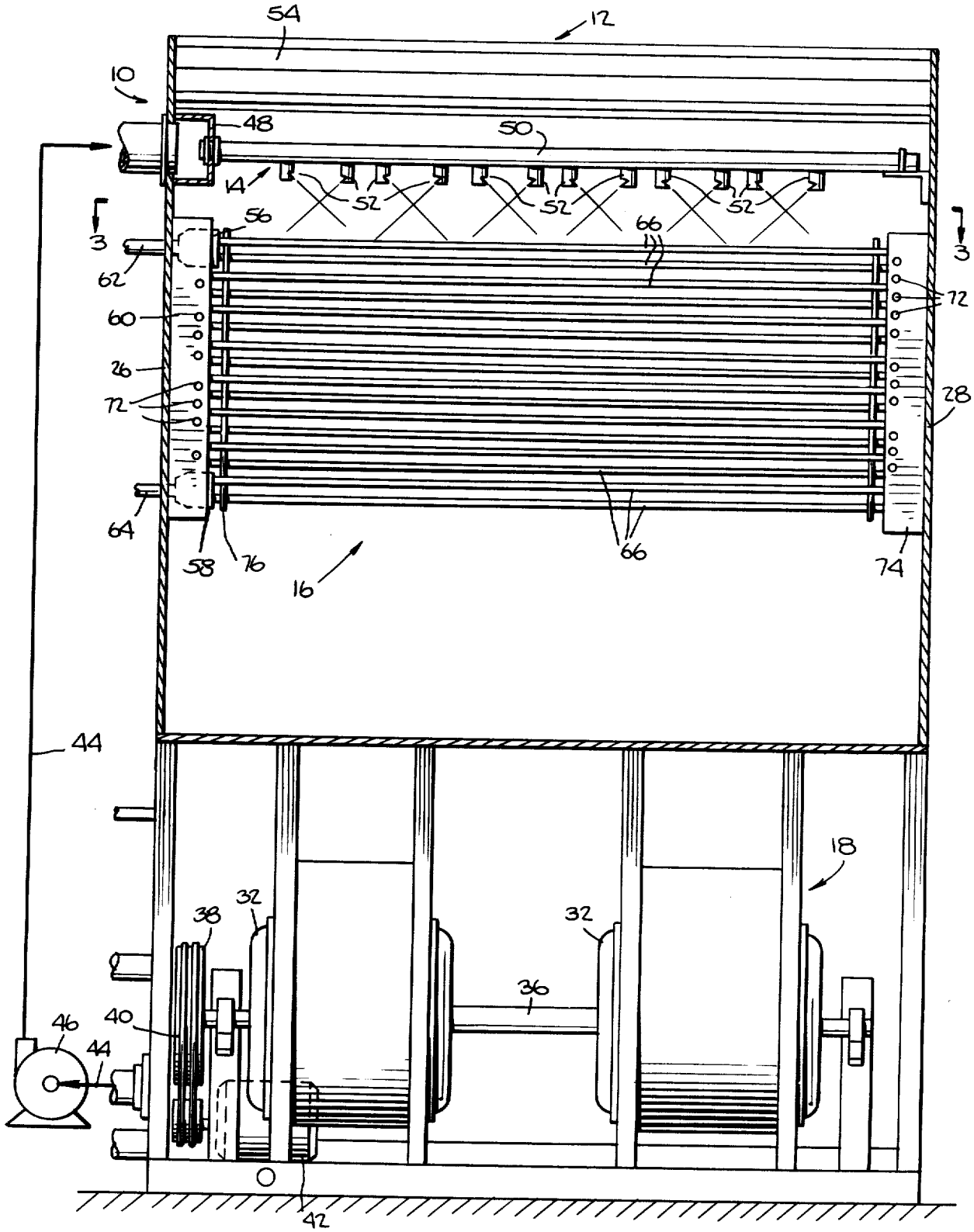
FIG. 2 is a front elevational view, partially broken away and partially in section, of the heat exchanger of FIG. 1.

The vertical conduit 10 is of rectangular, generally uniform, cross-section and it comprises vertical front and rear walls 24 and 22 (FIG. 1) and vertical side walls 26 and 28 (FIG. 2). A diagonal wall 30 extends downwardly from the front wall 24 to the bottom of the rear wall 22 to define the water trough 20. The fan assembly 18 is positioned behind and below the diagonal wall 30. The fan assembly comprises a pair of centrifugal fans 32 each of which has an outlet cowl 34 which projects through the diagonal wall 30 and into the conduit 10 above the water trough 20 and below the coil assembly 16. As shown in FIG. 2, the fans 32 share a common drive axle 36 and this axle is turned by means of a drive pulley 38 connected through a belt 40 to a drive motor 42.

A recirculation line 44 is arranged to extend through the side wall 26 of the conduit 10 near the bottom of the trough 20. The recirculation line extends from the trough 20 to a recirculation pump 46 and from there back up to the water spray assembly 14.

The water spray assembly 14 comprises a water box 48 which extends along the side wall 26 and a pair of distribution pipes 50 which extend horizontally from the water box across the interior of the conduit 10 to its opposite wall 28. Each of the pipes 50 is fitted with a plurality of nozzles 52 which emit mutually intersecting fan shaped water sprays to provide an even distribution of water over the entire coil assembly 16.

The mist eliminator assembly 12 comprises a plurality of closely spaced elongated strips 54 which are bent along their length to form sinuous paths from the region of the water spray assembly out through the top of the conduit 10. It will be noted that the mist eliminator assembly extends across substantially the entire cross-section of the conduit, and, since the cross-section of the conduit 10 is substantially uniform, the mist eliminator assembly occupies substantially the same cross-sectional area of the conduit 10 as the coil assembly 16.

Figure 3:
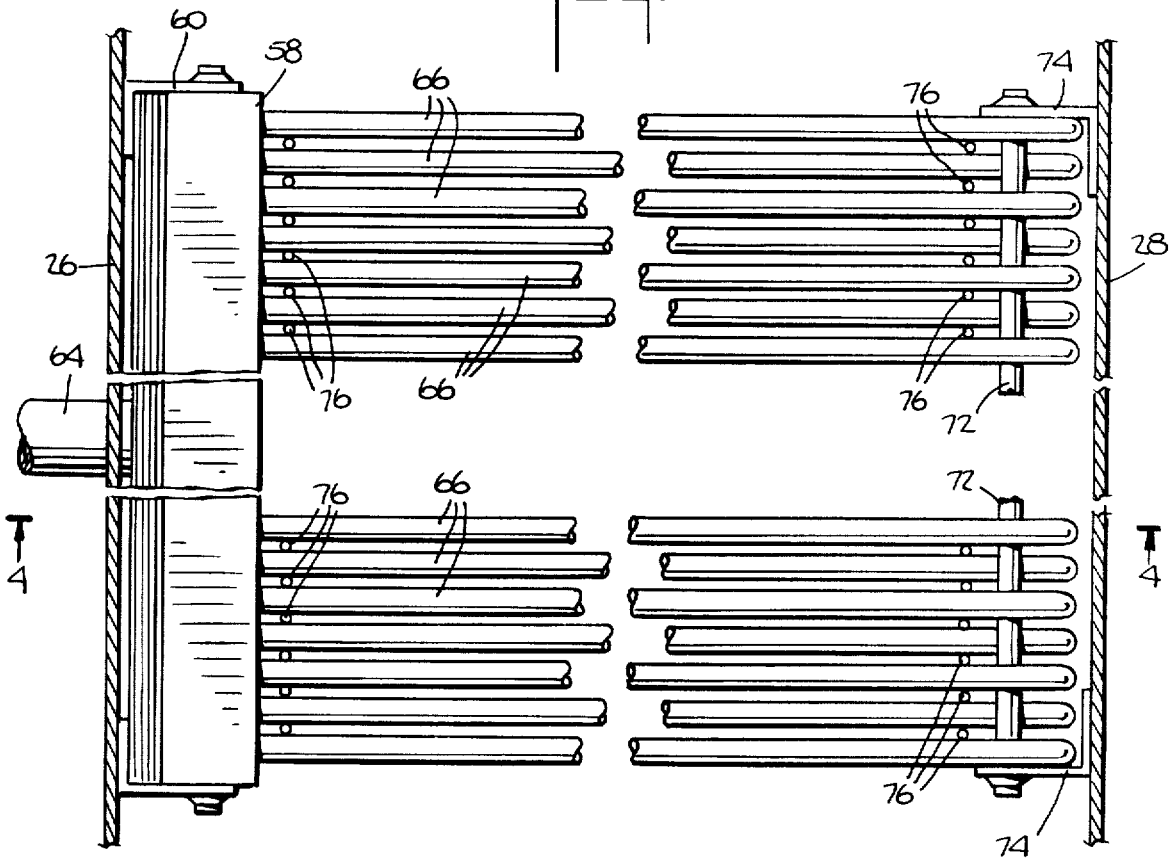
FIG. 3 is a view taken along line 3—3 of FIG. 2, partially broken away, and showing a coil assembly used in the heat exchanger.
Figure 4:
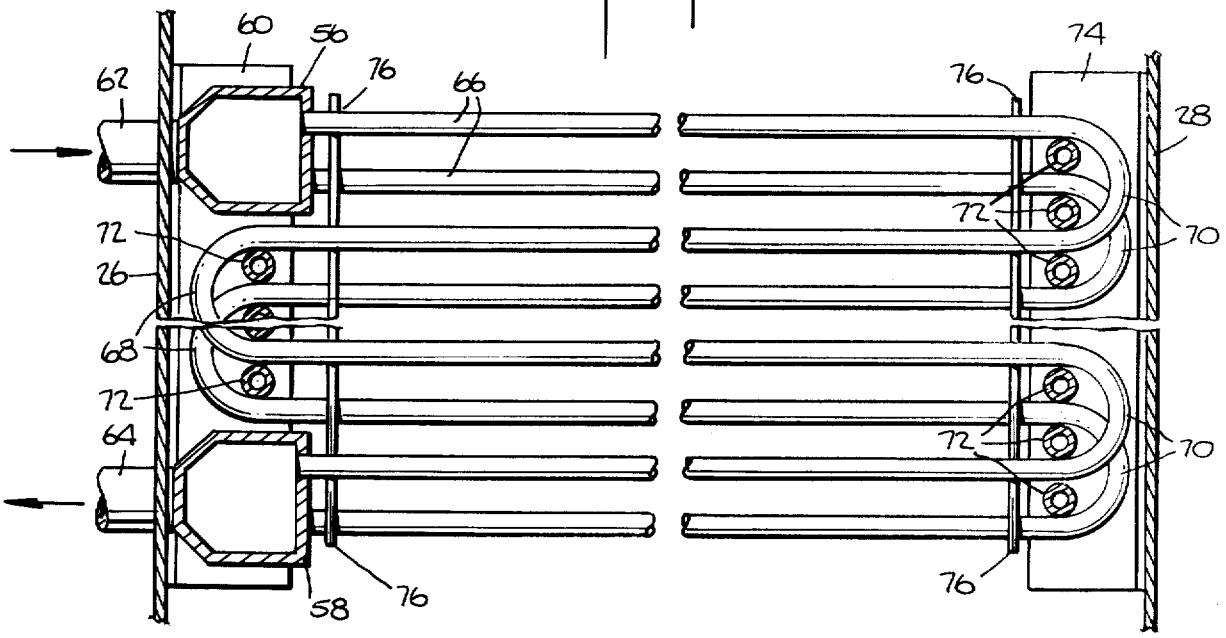
FIG. 4 is a view taken along line 4—4 of FIG. 3, and partially broken away.

The coil assembly 16 comprises an upper inlet manifold 56 and a lower outlet manifold 58 which extend horizontally across the interior of the conduit 10 adjacent the side wall 26. As can be seen in FIG. 3, the manifolds are held in place by means of brackets 60 on the side wall 26. Inlet and outlet fluid conduits 62 and 64 extend through the side wall 26 and communicate with the upper and lower manifolds 56 and 58 respectively. These fluid conduits are connected to receive a fluid to be cooled or condensed, for example the refrigerant from a compressor in an air conditioning system (not shown).

A plurality of cooling tubes 66 are connected between the upper and lower manifolds 56 and 58. Each tube is formed into a serpentine arrangement by means of 180° bends 68 and 70 (FIG. 4) near the side walls 26 and 28 so that different segments of each tube extend generally horizontally across the interior of the conduit 10 back and forth between the side walls 26 and 28 at different levels in the conduit along a vertical plane parallel and closely spaced to the plane of each of the other tubes 66. It will also be noted that the tubes 66 are arranged in alternately offset arrays with each tube being located a short distance lower or higher than the tubes on each side of it. It can be seen in FIG. 4 that each of the manifolds 56 and 58 is provided with an upper and a lower row of openings to accept the tubes 66 at these two different levels. In a preferred embodiment these tubes have an outside diameter of 1.05 inches (2.67 cm). It is also preferred that each 180° bend have a radius of two and three thirty second inches (5.32 cm) so that the segments of each tube will be vertically spaced apart from each other by four and three sixteenths inches (10.64 cm). Further, the corresponding levels of the segments of adjacent tubes should be offset vertically from each other by an amount equal to or greater than the tube diameter; and an offset of two and one tenth inches (5.33 cm) is preferred.

In order to support the tubes 66 at the bends 68 and 70 there are provided horizontally extending support rods 72 which are mounted at the wall 26, between the brackets 60 and, at the wall 28, between brackets 74.

There are also provided a plurality of vertical spacer rods 76 which extend between the adjacent tubes 66 near the support rods 72. The spacer rods 76 hold the adjacent tubes 66 a short distance from each other in the lateral direction as can be seen in the fragmentary perspective view of FIG. 5, and they are held in place frictionally between the tubes. The spacer rods 76 preferably have a diameter of 0.240 inches (0.61 cm).

Figure 6:
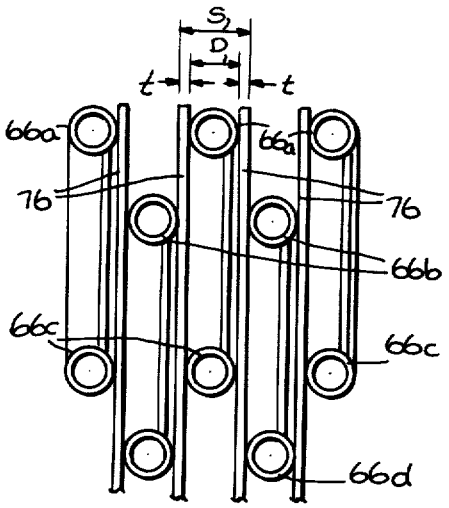
FIG. 6 is a diagrammatic repesentation of a view taken along line 6—6 of FIG. 5.
Figure 7:
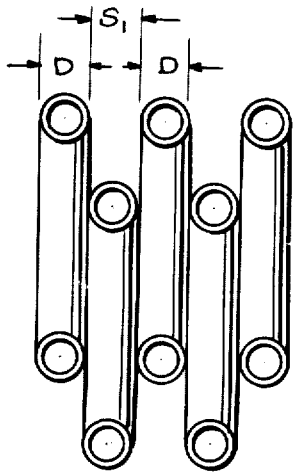
Fig. 7. Prior Art
FIG. 7 is a view similar to FIG. 6 but showing a prior art tube segment array.

As can be seen in FIG. 6, the coil assembly 16 in cross-section comprises arrays of tube segments 66*a*, 66*b*, 66*c* and 66*d* arranged at different levels or elevations due to the offset arrangement of adjacent tubes. In addition, the horizontal spacing S between the tube segments in each level is greater than the diameter of the tubes. More specifically, as shown, this spacing is equal to the diameter D of the tube segments plus twice the thickness t of each of the two spacer rods 76 between the adjacent tubes segments at each level. This differs from the prior art fully packed coil arrangement shown in FIG. 7 where no spacer rods are used. As can be seen in FIG. 7 the horizontal spacing $S_1$ between adjacent tube segments at each level is no greater than the tube diameter D. It can also be seen in FIGS. 5 and 6 that the vertical staggering of the adjacent sinuously shaped tubes 66 results in a staggering of the tube segments at adjacent levels, so that the tubes at one level are essentially centered between tubes at the next higher and next lower level. It will also be noted that the spacer rods 76 form clearances extending vertically down through the coil assembly equal in width to their thickness t. The thickness t of each spacer rod should be an appreciable amount, but not substantially greater than one half the diameter of the tubes 66. best results have been obtained when the spacer rod diameter is slightly less than one fourth of the tube diameter. With this spacer rod arrangement the tube segments at each level occupy less than fifty percent but not substantially less than twenty five percent of the coil assembly cross section and preferably forty percent of the coil assembly cross section.

In some instances it may be preferred to use tubes of non-circular cross section. The term "diameter" in such cases is to be understood as the diametrical distance across the tube cross section in a horizontal direction.

In operation of the heat exchanger of FIGS. 1–6 a fluid to be cooled or condensed, such as a refrigerant from an air conditioning system, flows into the heat exchanger via the inlet conduit 62. This fluid is then distributed by the upper manifold 56 to the upper ends of the cooling tubes 66; and its flows down through the tubes, back and forth across the interior of the conduit 10 at different levels therein until it reaches the lower manifold 58 where it is collected and transferred out of the heat exchanger via the outlet conduit 64. As the fluid being cooled flows through the tubes 66, water is sprayed from the nozzles 52 down over the outer surfaces of the tubes and air is blown from the fans 32 up between the tubes. The sprayed water collects in the trough 20 and is recirculated through the nozzles. The upwardly flowing air passes through the mist eliminator assembly 12 and exhausts up out of the system.

During its downward flow through the cooling tubes 66, the fluid being cooled gives up heat to the walls of the tubes. This heat passes outwardly through the tube walls to water flowing down over their outer surface. As the downwardly flowing water encounters the upwardly moving air, the water gives up heat to the air, both by sensible heat transfer and by latent heat transfer, i.e. by partial evaporation. The remaining water falls back down into the trough 20 where it collects for recirculation. As the upwardly moving air encounters the downwardly flowing water and extracts heat from the water, the air also entrains a certain amount of water in the form of droplets which it carries up out from the coil assembly 16 and up out of the water spray assembly 14. However, as the air passes through the mist eliminator assembly 12, its flow is changed rapidly in lateral directions and the liquid droplets carried by the air become separated from the air and are deposited on the elements of the mist eliminator. This water then falls back onto the spray and coil assemblies. Meanwhile the resulting high humidity, but essentially droplet free, air is exhausted out through the top of the conduit 10 to the atmosphere.

It is believed that the transfer of heat from the downwardly flowing water to the upwardly flowing air is enhanced by the high relative velocity between the water and air because the air shears the film of water flowing down over each tube. This shearing, it is believed, promotes heat transfer by increasing water surface area, by breaking surface tension and by reducing local ambient pressure. It is also thought that this shearing action becomes effective when the upward velocity of the air in the vicinity of the tubes is at least four hundred lineal feet (122 meters) per minute.

As explained in the standard handbook of the American Society of Heating, Refrigeration and Air Conditioning Engineers, two separate heat transfer processes are involved in the operation of evaporative heat exchangers. In the first heat transfer process, heat from the fluid beintg cooled or condensed passes through the tube walls to the water flowing over the tubes. In the second process, heat is transferred from the water flowing over the tubes to the upwardly flowing air. These two processes are described by the following equations:

1. $q = A\ (t_c - t_s)\ U_s$; and

2. $q = A\ (h_s - h_l)\ U_c$;

where $q$ = total heat transferred;
$A$ = total tube surface area;
$t_c$ = fluid temperature in the tubes;
$t_s$ = water temperature outside the tubes;
$U_s$ = heat transfer coefficient—fluid to water;
$h_s$ enthalpy of saturated air at $t_s$;
$h_l$ = enthalpy of ambient air; and
$U_c$ = heat transfer coefficient—water to air.

In both heat transfer processes the amount of heat transferred is directly proportioned to the total tube surface area. Also, in both processes, the coefficients $U_s$ and $U_c$ are proportioned to the relative velocities of the fluids. These two criteria indicate that maximum heat transfer will occur when a large number of closely spaced tubes are used in the coil assembly since such an arrangement maximizes tube surface area as well as air flow velocity in the region of the tubes.

It has been found, however, that heat transfer in a counterflow evaporative heat exchanger can be improved by arrangements which are contrary to that indicated by the foregoing heat transfer equations. That is, the heat transfer in a counterflow evaporative heat exchanger was found to increase when the number of tubes in the coil assembly was decreased and when the air flow velocity in the vicinity of the tubes was also decreased.

Figure 5:
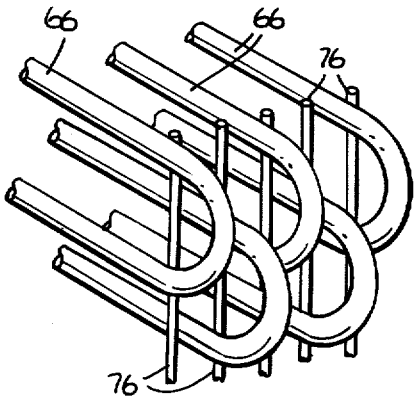
FIG. 5 is a fragmentary perspective view showing a tube segment array forming one portion of the coil assembly of FIGS. 3 and 4.
Figure 8:
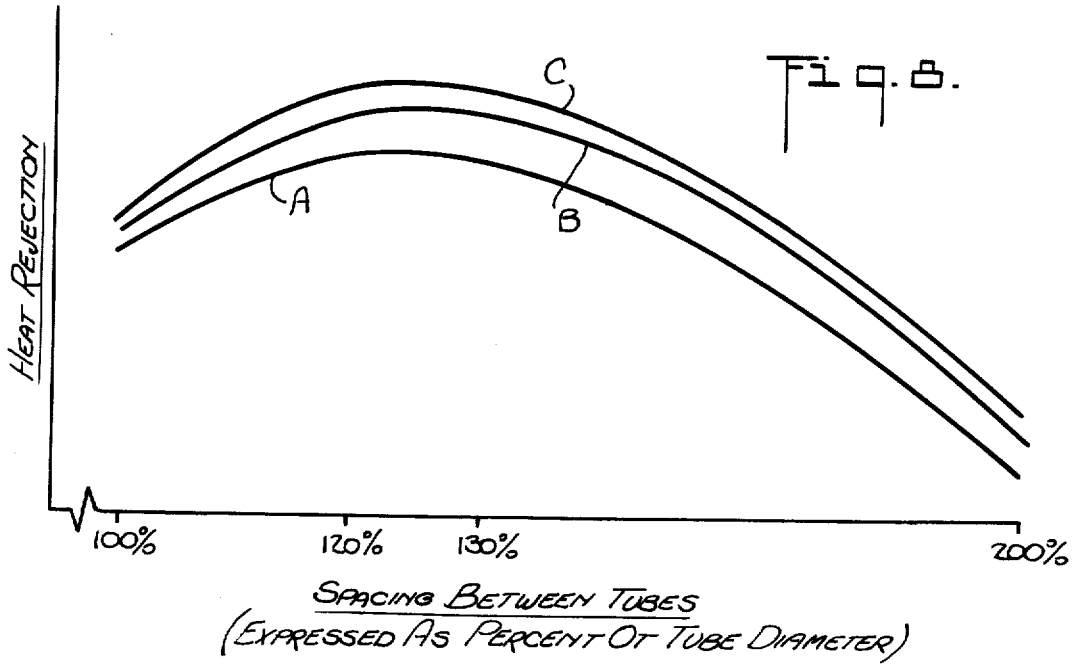
FIG. 8 is a graph showing comparative heat transfer characteristics of the present invention.

The amount by which heat transfer will be affected as the number of tubes is reduced and as tube spacing is increased can be seen in the diagram of FIG. 8. In this diagram, heat rejection is plotted against tube spacing, expressed as a percentage of tube diameter, for a coil assembly as shown in FIG. 5–7. The different tube spacings are obtained by removal of tubes from the coil assembly and repositioning the remaining tubes to maintain the same overall coil assembly cross section. In the example used the minimum tube spacing is equal to one tube diameter; and this corresponds to the spacing $S_1$ in FIG. 7. Three different curves A, B and C represent the heat rejection for different flow rates of water sprayed over the tubes, with curve A corresponding to three gallons per square foot (122 liters per square meter) of projected area of coil assembly cross section per minute, curve B corresponding to four and one half gallons per square foot (183 liters per square meter) and curve C corresponding to six gallons per square foot (244 liters per square meter) per minute.

As can be seen in FIG. 8, as the tube spacing is increased from one hundred percent of tube diameter (prior art), the amount of heat transfer actually increases up to a maximum where the tube spacing corresponds to one hundred twenty percent of tube diameter. This corresponds to a reduction of about twenty percent in the total tube surface area of the coil assembly; and it also represents a significant reduction in the cost of the coil assembly. As the tube spacing is further increased, and the total number of tubes is correspondingly decreased, the overall heat transfer from the coil assembly also decreases, but it remains higher than for the closely packed coil assemblies of the prior art until the tube spacing is about one hundred thirty percent of the tube diameter. This corresponds to a reduction of about thirty percent of the total tube surface area of the tube assembly. Even when the tube spacing is further increased, the amount of heat transfer per unit area of cooling tube surface remains higher than for prior art closely packed coil assemblies. However, the total heat transfer of the overall coil assembly falls off beyond practical limits when the number of tube spacing is about two hundred percent of tube diameter, i.e. when the spacing at each level in the conduit is about twice the tube diameter. It will be understood that as the tube spacing is increased, the thickness of the spacer rods 76 is correspondingly increased.

The upward velocity of the air between the tubes 66 should be at least four hundred feet (122 meters) per minute, but less than fourteen hundred feet (427 meters) per minute and, preferably, about one thousand feet (305 meters) per minute to obtain the benefits of this invention. It has been found that when air is blown into the conduit 10 at a velocity of about six hundred feet (183 meters) per minute, the performance characteristics of FIG. 8 can be expected. It will be appreciated that for a given flow rate of air into the conduit 10 the velocity of the air in the region of the tubes will increase in inverse proportion to the amount of space between the tubes so that in a closely packed coil assembly the air velocity will be generally higher than in a coil assembly having spaced apart tubes.

It has been found also that the use of the spaced tube coil assembly of the present invention makes it possible to obtain additional improvements in heat transfer by increased rates of water spray. As can be seen at the extreme right side of the diagram of FIG. 8, where curves A, B and C essentially merge, the amount of water sprayed over the closely packed coil assembly of the prior art does not have a significant effect on heat transfer; however, where the spaced tube coil assembly of the present invention is used, heat transfer can be significantly increased by increasing the amount of water sprayed over the coil assembly. The use of a large cooling water flow rate provides a still further advantage in that it improves the washing effect of the cooling water and reduces scale buildup on the tubes.

While it is not known positively why the spaced tube coil assembly of this invention provides improved heat transfer, it is believed that two factors cooperate to bring about this effect.

Firstly, it is thought that the reduced air velocity which results from the increased tube spacing prevents the air from scrubbing the downwardly flowing water from the tube surfaces. In this manner the total tube surface area through which heat can transfer directly to the downwardly flowing water is maximized. While the upward velocity of the air between the tubes should be sufficient to produce a shearing action on the water films flowing over the tubes, and even an entrainment of droplets which are carried up out of the coil assembly, the upward velocity of the air should not be so great that it actually strips the film from the surface of the tube. It is believed that if the air velocity is too high, the air will scrub the water film from the tube surface effectively reducing heat transfer surface area so that heat transfer from the tube will be impaired. It is also believed that the velocity of the air in the vicinity of the tubes should be less than fourteen hundred feet (427 meters) per minute.

The second factor involved in the enhancement of heat transfer in the system of the present invention is the greater flow velocity which the fluid being cooled or condensed must undergo in passing through a reduced number of tubes. In order to accommodate a given amount of fluid to be cooled with a coil assembly having fewer cooling tubes than prior art coil assemblies, it is necessary, in the case of the present invention, for the fluid being cooled to flow at a higher velocity through the cooling tubes than it did in prior art closely packed coil assembly tubes. This higher velocity enhances the heat transfer from the fluid being cooled to the tube walls.

The foregoing factors are believed to cooperate in combination to provide a counterflow type heat exchanger with greater heat transfer capability and lower cost than was obtained by the prior art.

It is to be understood that regardless of the correctness of the foregoing explanation, it has been found in actual tests that the phenomenon of improved heat transfer is obtained when the tube spacing is maintained such that at each level in the coil assembly the adjacent tube segments are spaced apart by more than one tube diameter but not substantially more than two tube diameters, and when the velocity of the air in the vicinity of the tubes is maintained at less than fourteen hundred feet (427 meters) per minute but not substantially less than six hundred feet (183 meters) per minute; and it has found that maximum heat transfer is obtained when the adjacent tube segments are spaced apart by about one and one half tube diameters and when the velocity of the air in the vicinity of the tubes is maintained at about one thousand feet (305 meters) per minute.

It is to be understood that the present invention does not pertain to co-current flow heat exchangers wherein the sprayed water and cooling air both flow in parallel or downwardly past a coil assembly. In those systems the relative velocity between the air and the water is not high and the overall heat transfer capability of such devices is much lower than in counterflow heat exchangers of similar size. Co-current flow heat exchangers employ coil assemblies with large spacings between the adjacent tubes for the same reason that prior art countercurrent flow heat exchangers employ coil assemblies with small spacings between the adjacent tubes, namely, to increase the relative velocity between the air and the water by allowing the air to move more freely over the water without carrying the water along with it. In this invention however, the tube spacing in a countercurrent heat exchanger is increased in order to reduce the velocity of the air moving up against the downwardly flowing water, which is precisely opposite to the purpose of spacing tubes in prior art co-current flow evaporation heat exchangers.

The present invention is also not concerned with heat exchangers, even of the counterflow type, in which air velocities are so low that the upwardly flowing air did not entrain any appreciable amount of water. In those devices no substantial amount of heat transfer was obtained and if any mist eliminator was needed at all, it would only be employed where the air exhaust was through a very small opening which produced high air exit velocities far greater than the air velocity over the cooling tubes. In the case of the present invention, air velocities in the region of one thousand feet (305 meters) per minute are employed in the region of the cooling tubes and accordingly in order to enable the entrained water to be removed from the air the mist eliminator assembly 12 should extend over substantially the same cross-sectional area as the coil assembly 16. In this manner the air velocity in the region of the mist eliminator assembly will not be appreciably higher than in the region of the coil assembly and the mist eliminator assembly will be effective to remove the majority of the entrained water from the exiting air.

Figure 9:
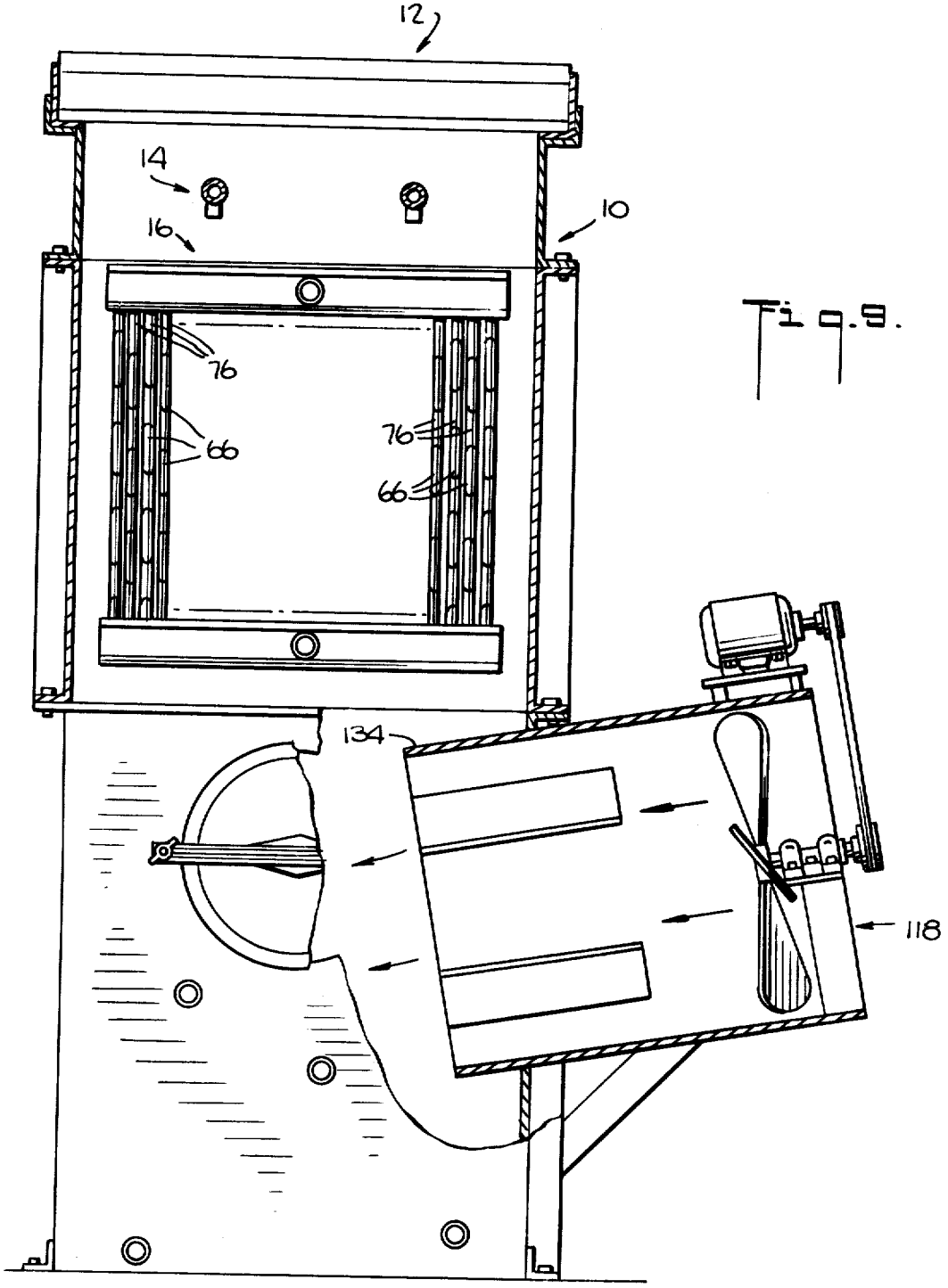
FIG. 9 is a view similar to FIG. 1 but showing a modification of the heat exchanger.

FIG. 9 shows a modified version of the present invention. The heat exchanger shown in FIG. 9 is the same as that of FIGS. 1–6 in all respects except that in FIG. 9 there is provided a propeller assembly 118 which replaces the fan assembly 18 of the preceding embodiment. The propeller assembly 118 blows air into the conduit 10 via a cowl 134 in a manner similar to the centrifugal fans 32. The propeller assembly 118 is capable of moving as large a quantity of air as the centrifugal fan 32 but with substantially less power than is required by the centrifugal fan. In order for a propeller to operate efficiently to move large quantities of air, however, it is important that the static pressure difference between the propeller input and output be minimized. With the open or spaced tube coil assembly of the present invention the pressure drop across the coil is minimized and accordingly it becomes possible with the present invention to employ a propeller drive for the cooling air in a very efficient manner.

It has also been found that the spaced tube coil assembly of the present invention, with its vertical clearances between adjacent tubes provides access for tools and cleaning implements to all tube surfaces and thereby maintenance of the coil assembly is facilitated.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. An evaporative counterflow heat exchanger comprising a conduit of generally uniform cross section extending in a vertical direction, a coil assembly positioned inside said conduit, said coil assembly comprising inlet and outlet manifolds and a plurality of tubes connected between the manifolds with different segments of the tubes extending generally horizontally across the conduit in equally spaced relation to each other at different levels in the conduit, means maintaining said tubes spaced apart from each other by an amount such that the spaces between adjacent tubes at each level are each greater, by a finite amount, than the diameter of said tubes but are less than twice the tube diameter, liquid distribution means arranged in said conduit above said coil assembly to distribute liquid down through said conduit and over said coil assembly, fan means arranged to move a gas up through said conduit between said tube segments in counterflow relationship to said liquid at a velocity sufficient to entrain liquid from said coil assembly and carry said liquid up past said liquid distribution means, and mist eliminator means extending across substantially the entire cross section of said conduit above said liquid distribution means.

2. An evaporative counterflow heat exchanger according to claim 1 wherein the tubes in adjacent levels are staggered horizontally with respect to each other.

3. An evaporative counterflow heat exchanger according to claim 1 wherein said levels are also separated by a distance at least as great as the tube diameter.

4. An evaporative counterflow heat exchanger according to claim 1 wherein each tube extends back and forth across said conduit in a serpentine manner in a vertical plane between a common upper manifold and a common lower manifold.

5. An evaporative counterflow heat exchanger according to claim 4 wherein laterally adjacent tubes are staggered vertically with respect to each other to produce horizontal staggering of the tube segments at adjacent levels.

6. An evaporative counterflow heat exchanger according to claim 1 or 4 or 5 wherein said coil assembly includes vertically extending spacer elements positioned between the adjacent tubes to space them horizontally from each other.

7. An evaporative counterflow heat exchanger according to claim 6 wherein said spacer elements are squeezed between and frictionally held in place by said tubes.

8. An evaporative counterflow heat exchanger according to claim 1 wherein said fan means is of a size capable of blowing gas up through said conduit at a rate of at least four hundred feet (122 meters) per minute.

9. An evaporative counterflow heat exchanger according to claim 1 wherein said fan means is of a size capable of blowing air at a velocity of about one thousand feet (305 meters) per minute in the vicinity of said tubes.

* * * * *